US006008771A

United States Patent [19]

Tanaka et al.

[11] Patent Number: 6,008,771

[45] Date of Patent: Dec. 28, 1999

[54] ANTENNA WITH NONRADIATIVE DIELECTRIC WAVEGUIDE

[75] Inventors: Nobuaki Tanaka; Kazunari Kawahata; Youhei Ishikawa, all of Kyoto; Seiichi Arai, Osaka, all of Japan

[73] Assignee: Murata Manufacturing Co., Ltd., Kyoto, Japan

[21] Appl. No.: 08/944,048

[22] Filed: Sep. 8, 1997

Related U.S. Application Data

[63] Continuation of application No. 08/584,521, Jan. 9, 1996, abandoned.

[30] Foreign Application Priority Data

Jan. 9, 1995 [JP] Japan ..... 7-001506

[51] Int. Cl.[6] ..... H01Q 13/10

[52] U.S. Cl. ..... 343/767; 343/700 MS; 343/771; 343/785; 343/909; 333/219.1; 333/248

[58] Field of Search ..... 343/700 MS, 767, 343/771, 785, 909, 911 R, 846; 333/219.1, 237, 239, 248, 219.2

[56] References Cited

U.S. PATENT DOCUMENTS

| | | | |
|---|---|---|---|
| 2,977,593 | 3/1961 | Kienow | 343/785 |
| 2,993,205 | 7/1961 | Cooper | 343/785 |
| 4,053,897 | 10/1977 | Nerheim | 343/785 |
| 4,521,746 | 6/1985 | Hwan et al. | 333/219.1 X |
| 4,728,913 | 3/1988 | Ishikawa et al. | 333/219.1 X |
| 4,821,006 | 4/1989 | Ishikawa et al. | 333/219.1 X |
| 5,185,613 | 2/1993 | Whatmore et al. | 343/911 R X |
| 5,266,961 | 11/1993 | Milroy . | |
| 5,352,997 | 10/1994 | Sarkka | 333/219.1 |
| 5,517,203 | 5/1996 | Fiedziuszko | 333/219.1 X |

FOREIGN PATENT DOCUMENTS

| | | |
|---|---|---|
| 0618642 | 3/1993 | European Pat. Off. . |
| 0615305 | 3/1994 | European Pat. Off. . |

OTHER PUBLICATIONS

"Aperture Coupled Microstrip Patch Antenna Fed By Nonradiating Dielectric Waveguide", C.J. Reddy, et al., Electronics Letters, vol. 29, No. 25, 215 (1993).

"Leaky NRD Guide As a Feeder for Microwave Planar Antennas", K. Maamria, et al., IEEE Transactions on Antennas and Propagation, vol. 41, No. 12, 1680 (1993).

"Admittance Characteristics of Narrow Radiating Slots in Nonradiating Dielectric Waveguide", C.J. Reddy, et al., IEEE Proceedings–H, vol. 140, No. 5, 407 (1993).

*Primary Examiner*—Don Wong
*Assistant Examiner*—Tho Phan
*Attorney, Agent, or Firm*—Majestic, Parsons, Siebert & Hsue P.C.

[57] ABSTRACT

An antenna includes a cylindrically shaped dielectric resonator placed on a longitudinally extended axis of an elongated dielectric strip disposed on a planar conductor and another planar conductor having an opening covers the dielectric strip with the opening on the dielectric resonator. There may be another dielectric strip placed perpendicularly to the first dielectric strip such that the dielectric resonator is where the lines longitudinally extended from the axes of both dielectric strips will cross.

39 Claims, 5 Drawing Sheets

ANTENNA WITH NONRADIATIVE DIELECTRIC WAVEGUIDE

This is a continued prosecution application of pending prior application Ser. No. 08/944,048, filed Sep. 8, 1997, which is a FWC of prior application Ser. No. 08/584,521, filed Jan. 9, 1996, now abandoned.

BACKGROUND OF THE INVENTION

This invention relates to a millimeter wave antenna using nonradiative dielectric waveguide (NRD guide) used in particular, for example, in a collision-warning radar for an automobile.

Prior art millimeter wave NRD guide antennas are shown in FIGS. 8 and 9. FIG. 8 shows a NRD guide comprising planar conductors 51 and 52 sandwiching therebetween a dielectric strip 53. An antenna 54 is formed by connecting a transceiver circuit (not shown) at one end of the NRD guide and causing the dielectric strip 53 to protrude from between the conductors 51 and 52. The antenna 54, thus formed, is adapted to emit electromagnetic waves in the longitudinal direction of the dielectric strip 53 (in the direction of the X-axis in FIG. 8).

FIG. 9 shows a planar antenna 66 comprising a dielectric strip 61 having notches 61*a* formed in the direction of its width (in the direction of the X-axis in FIG. 9) for radiating electromagnetic waves and a coaxial line 62 attached to its side surface near one end for feeding in power. A NRD guide structure is formed by attaching planar conductors 63 and 64 on the upper and lower surfaces of the dielectric strip 61, and the antenna 66 is formed by providing a plurality of slots 65 to the conductor 63 on the upper surface in the longitudinal direction of the dielectric strip 61 (in the direction of the Y-axis in FIG. 9). The planar antenna 66, thus formed, is adapted to radiate electro-magnetic waves from the dielectric strip 61 in the horizontal direction (in the direction of the X-axis in FIG. 9). Electromagnetic waves are radiated through the slots 65 in the perpendicular direction to the planar antenna 66 (in the direction of the Z-axis in FIG. 9) if the slots 65 are formed in the conductor 63 with intervals therebetween equal to its wavelength.

If the prior art antenna 54 is used in a collision-warning radar and is to be attached in such a way that the direction of electromagnetic waves radiated therefrom will coincide with the direction of motion of the automobile, the antenna 54 must be disposed parallel to the direction of motion of the automobile because it can radiate electric waves only in the longitudinal direction of its dielectric strip 53 (in the direction of the X-axis in FIG. 8). Since this may cause the conductors 51 and 52 of the antenna 54 to protrude, for example, into the engine room, there is a severe limitation as to where the antenna 54 can be attached.

As for the prior art planar antenna 66, since it is used in the millimeter waveband, a high level of precision is required in the production of the notches 61*a* in the dielectric strip 61 and the slots 65 of the conductor 63. Since a plurality of slots 65 are required, furthermore, the surface area of the conductors 63 and 64 becomes large, and if the conductors 63 and 64 are not sufficiently strong, the conductors 63 and 64 tend to bend, causing fluctuations in antenna characteristics. Since the gain of the antenna 54 depends on the length of the dielectric strip 53, furthermore, antenna efficiency of only 20% to 50% can be attained if the loss in the dielectric strip 53 is taken into consideration. In order to increase the gain, therefore, the planar antenna 54 must be made large.

SUMMARY OF THE INVENTION

It is therefore an object of this invention to eliminate such problems of prior art antennas by providing an antenna having a dielectric resonator on the extension of the axis of a dielectric strip disposed between conductors and adapted to radiate electromagnetic waves from this dielectric resonator in perpendicular directions.

It is another object of this invention to provide a compact high-gain antenna.

An antenna embodying the present invention, with which the above and other objects can be accomplished, may be characterized as comprising a longitudinally elongated dielectric strip disposed on a first planar conductor, a dielectric resonator disposed on a longitudinally extended axis of the dielectric strip, and a second planar conductor covering upper surface of the dielectric strip and having an opening (that is, an aperture or a slot) above the dielectric resonator. Alternatively, such an antenna may be characterized as comprising two longitudinally elongated dielectric strip mutually perpendicularly disposed on a first planar conductor, a dielectric resonator disposed at a point where longitudinally extended axes of these two dielectric strips cross each other, and a second planar conductor covering upper surfaces of the dielectric strips and having an opening above the dielectric resonator. The opening may be in the shape of a rectangle or a cross. Further, the opening may be cross-sectionally trapezoidal. The dielectric resonator may be further provided with a dielectric rod through the opening, and such a dielectric rod may be formed unitarily with the dielectric resonator. An additional dielectric resonator or resonators may be additionally inserted between the dielectric strip and the dielectric resonator, and a dielectric lens may be provided over the opening to further improve the antenna characteristics.

With an antenna thus structured, electromagnetic waves transmitted to the dielectric strip couple to the dielectric resonator disposed on the extension of the axis of the dielectric strip and electromagnetic waves are radiated in the perpendicular directions of the antenna from the resonator which resonates.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Components which are substantially alike, although of antennas according to different embodiments, are indicated by the same numerals.

DETAILED DESCRIPTION OF THE INVENTION

Figure 1A:
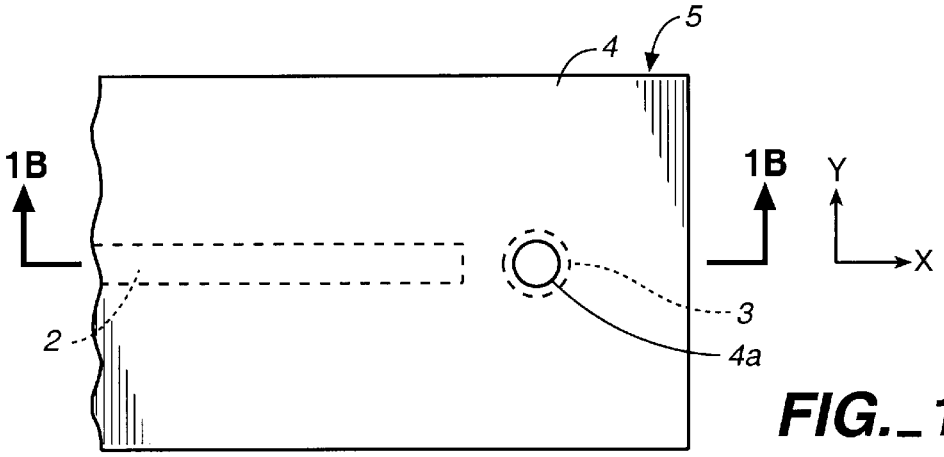
FIG. 1A is a plan view of an antenna according to a first embodiment of this invention.
Figure 1B:
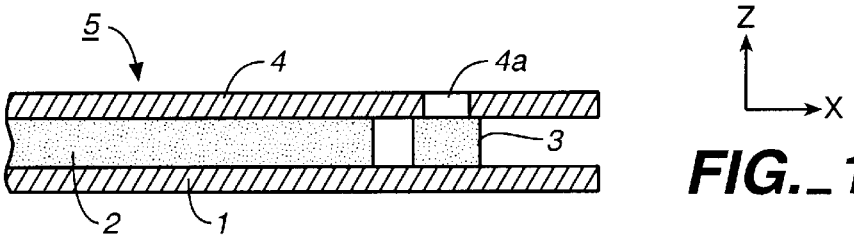
FIG. 1B is a sectional view thereof taken along line 1B—1B of FIG. 1A.

Examples of antennas embodying this invention are described next with reference to drawings. As shown in FIGS. 1A and 1B, an antenna 5 according to a first embodiment of this invention comprises a first planar conductor 1 of a material such as aluminum, an elongated dielectric strip 2 in the form of a bar, a cylindrically shaped dielectric resonator 3, and a second planar conductor 4 also of a material such as aluminum having a circular opening 4*a*. The dielectric strip 2 is disposed on the upper surface of the first planar conductor 1, being in a face-to-face contacting relationship with the first and second planar conductor 1 and 4, and has one of its ends connected to a waveguide or a transmission circuit (not shown), the other end forming a planar surface at a position not reaching the opening 4*a* in the second planar conductor 4 which covers the upper surface of the dielectric strip 2 and forms an open end part with the first planar conductor 1. The cylindrically shaped dielectric resonator 3 is disposed between the first and second planar conductors 1 and 4 at the position of the opening 4*a* which is on the longitudinal extension (in the direction of the X-axis shown in FIGS. 1A and 1B) of the axis of the dielectric strip 2.

The antenna 5, thus structured, forms a NRD guide with its conductors 1 and 4 and dielectric strip 2 such that electromagnetic waves transmitted to the dielectric strip 2 from the waveguide or transmission circuit (not shown) connected thereto propagate within the dielectric strip 2 in the LSM mode, generating an electric field $E_1$ with a component in the direction (of the Y-axis in FIG. 1) perpendicular to the longitudinal direction (X-axis in FIG. 1) of the dielectric strip 2 and parallel to the principal surfaces of the planar conductors 1 and 4 and a magnetic field $H_1$ having a component perpendicular to the principal surfaces of the planar conductors 1 and 4. The dielectric strip 2 and the dielectric resonator 3 are electromagnetically coupled, and the $HE_{111}$ mode with an electric field $E_2$ having a component in the same direction as the electric field $E_1$ of the dielectric strip 2 is generated inside the dielectric resonator 3. Electromagnetic waves are thus radiated from the dielectric resonator 3 through the opening 4*a* in the direction perpendicular to the principal surface of the second planar conductor 4 (in the direction of the Z-axis in FIG. 1). If the antenna 5 is installed in an automobile, for example, the opening 4*a* can thus be easily oriented in the direction of its motion.

Figure 2A:
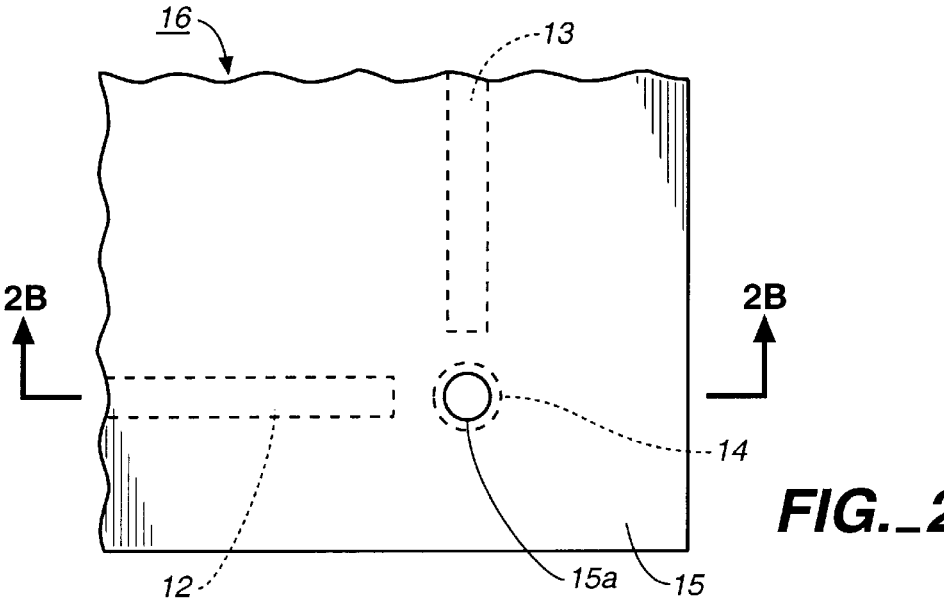
FIG. 2A is a plan view of an antenna according to a second embodiment of this invention.
Figure 2B:
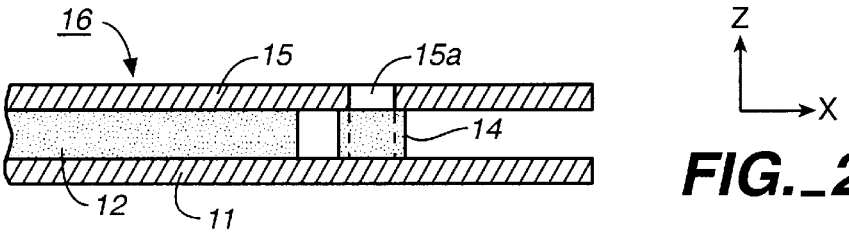
FIG. 2B is a sectional view thereof taken along line 2B—2B of FIG. 2A.

FIGS. 2A and 2B show another antenna according to a second embodiment of this invention, comprising a first planar conductor 11, elongated dielectric strips 12 and 13 in the form of a bar and disposed on the first planar conductor 11, a cylindrically shaped dielectric resonator 14, and a second planar conductor 15 covering the upper surfaces of the dielectric strips 12 and 13 and having a circular opening 15*a* on the dielectric resonator 14. The dielectric strips 12 and 13 each have one end connected to a waveguide or a transmission circuit (not shown) and the other end in a planar form, being oriented perpendicularly to each other such that the lines extended longitudinally therefrom cross each other at the position of the dielectric resonator 14.

The antenna 16, thus structured, forms a NRD guide with its conductors 11 and 15 and dielectric strips 12 and 13. If electromagnetic waves with the same amplitude are transmitted to the dielectric strips 12 and 13 such that their phases at the end surfaces are off by 90 degrees, it is possible to radiate circularly polarized electromagnetic waves from the dielectric resonator 14 through the opening 15*a* in the direction perpendicular to the principal surfaces of the second planar conductor 15 (in the direction of the Z-axis in FIG. 2B).

Figure 3A:
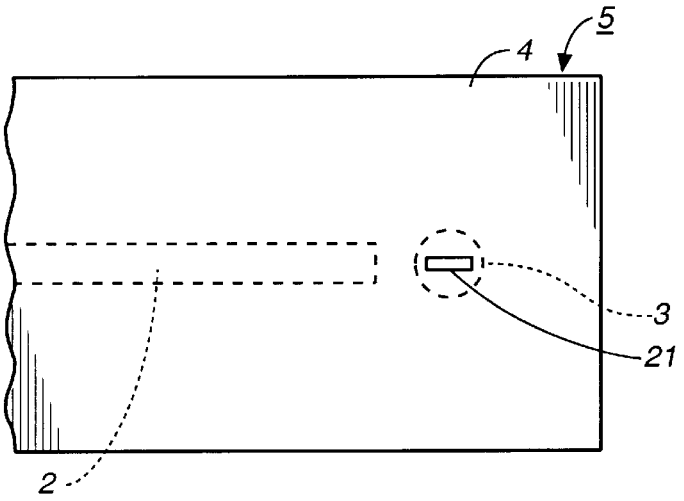
FIGS. 3A and 3B are plan views of the antennas of FIGS. 1A and 1B and FIGS. 2A and 2B with differently shaped openings.
Figure 3B:
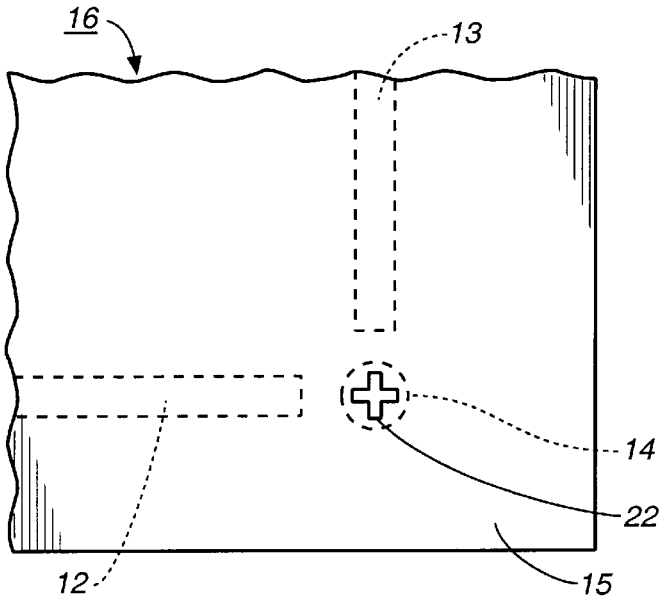

FIGS. 3A and 3B show how the shapes of the openings in the conductors 4 and 15 can be modified. FIG. 3A shows the planar conductor 4 of the antenna 5 having a rectangularly shaped opening 21. FIG. 3B shows the planar conductor 15 of the antenna 16 having a cross-shaped opening 22. Since the magnetic flow changes with the shape of the opening thus modified, it is possible to obtain antennas with different radiation pattern.

Figure 4:
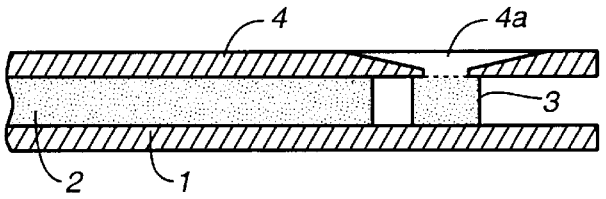
FIG. 4 is a sectional view of an opening of another antenna differently shaped sectionally.

If the openings 4*a*, 15*a*, 21 and 22 are made trapezoidal as shown in FIG. 4, the reflection loss can be reduced, with the gain improved.

FIGS. 5A and 5B and FIGS. 6A and 6B show antennas 31 and 41 respectively according to a third embodiment and a fourth embodiment of this invention. Since the basic antenna structures according to these embodiments are similar to the structure shown in FIGS. 1A and 1B, components which are identical to those shown in FIGS. 1A and 1B are indicated by the same numerals and not repetitively explained.

The antenna 31 is characterized not only as having an upper planar conductor 4 with an opening 4*a* but also as including a dielectric rod 32 which has a conically shaped upper part and of which the bottom surface contacts the upper surface of the dielectric resonator 3. In the antenna 31 thus structured, resonance in the $HE_{111}$ mode coupled inside the dielectric resonator 3 couples with the $HE_{11}$ mode which is the propagation mode of the dielectric rod 32, and the dielectric rod 32 radiates electromagnetic waves, serving as a dielectric rod antenna which has a better radiation pattern than the antennas 5 and 16 adapted to radiate waves through a simple opening and hence has an improved antenna gain. Although not separately illustrate, the antenna 16 shown in FIGS. 2A and 2B may similarly be provided with a dielectric rod with a conically shaped top part. If the dielectric rod 32 is formed unitarily with the dielectric resonator 3 or 14, respectively of the antenna 5 or 16, the production and assembly process becomes simplified.

Figure 5A:
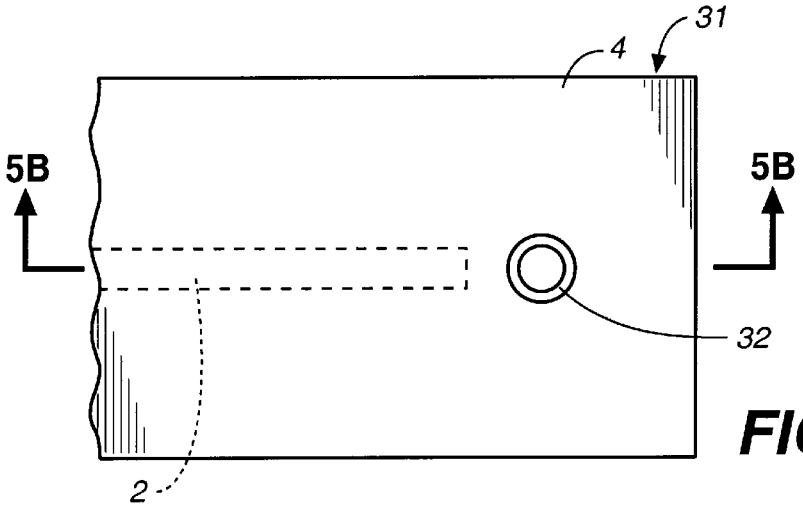
FIG. 5A is a plan view of an antenna according to a third embodiment of this invention.
Figure 5B:
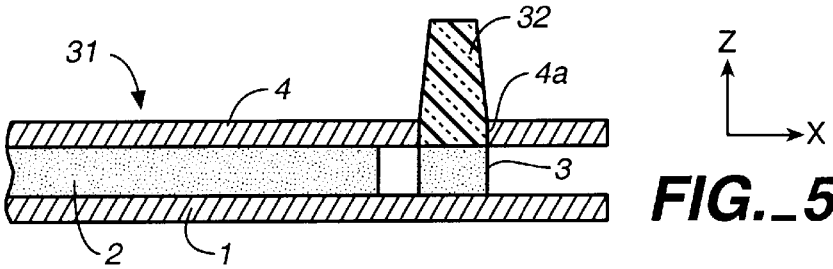
FIG. 5B is a sectional view thereof taken along line 5B—5B of FIG. 5A.
Figure 6A:
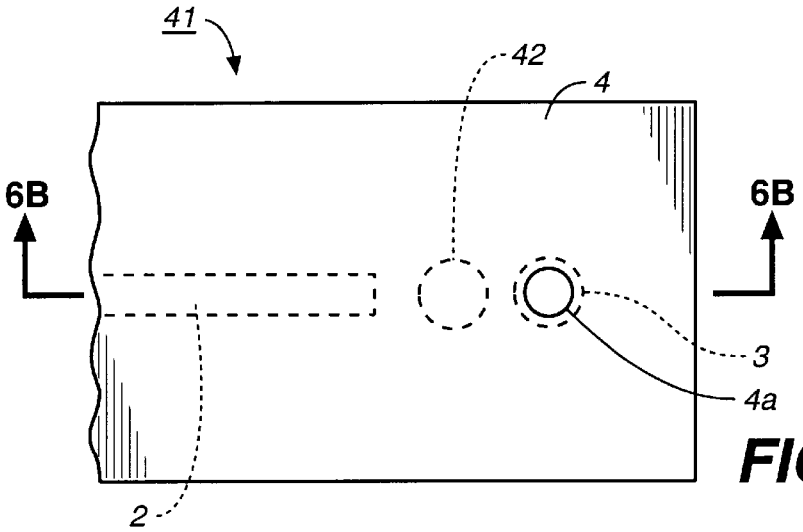
FIG. 6A is a plan view of an antenna according to a fourth embodiment of this invention.
Figure 6B:
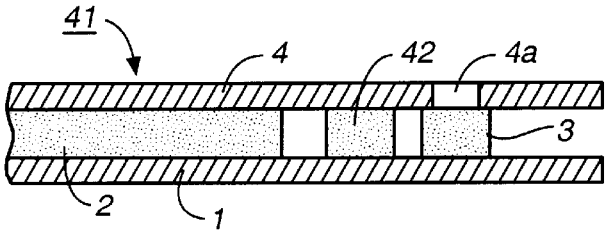
FIG. 6B is a sectional view thereof taken along line 6B—6B of FIG. 6A.

The antenna 41, shown in FIGS. 6A and 6B, is characterized not only as having a dielectric strip 2 and a dielectric resonator 3 but also additionally having another dielectric resonator 42 therebetween. Since resonance takes place twice in the antenna 41 thus structured, it has a better filtering effect against spurious radiation associated with secondary harmonics, say, at the time of transmission, preventing unwanted effects on other reception systems or other similar systems. If a plurality of such additional dielectric resonators are placed on the axis extended from the dielectric strip, the filtering effect and the band width of the antenna can be improved even more. It also goes without saying such additional dielectric resonators may be inserted similarly between any of the dielectric strips 12, 13 and 2 shown in FIGS. 2A, 2B, 5A and 5B and the associated dielectric resonator 14 or 3 of the antenna 16 or 31 to yield similar filtering effects. Although dielectric resonators 3, 14 and 42 with a circularly cylindrical shape have been disclosed above, they may be cylindrical with a polygonal sectional shape. The upper part of the dielectric rod 32 shown in FIGS. 5A and 5B may also be in the shape of a pyramid, instead of a cone.

Figure 7:
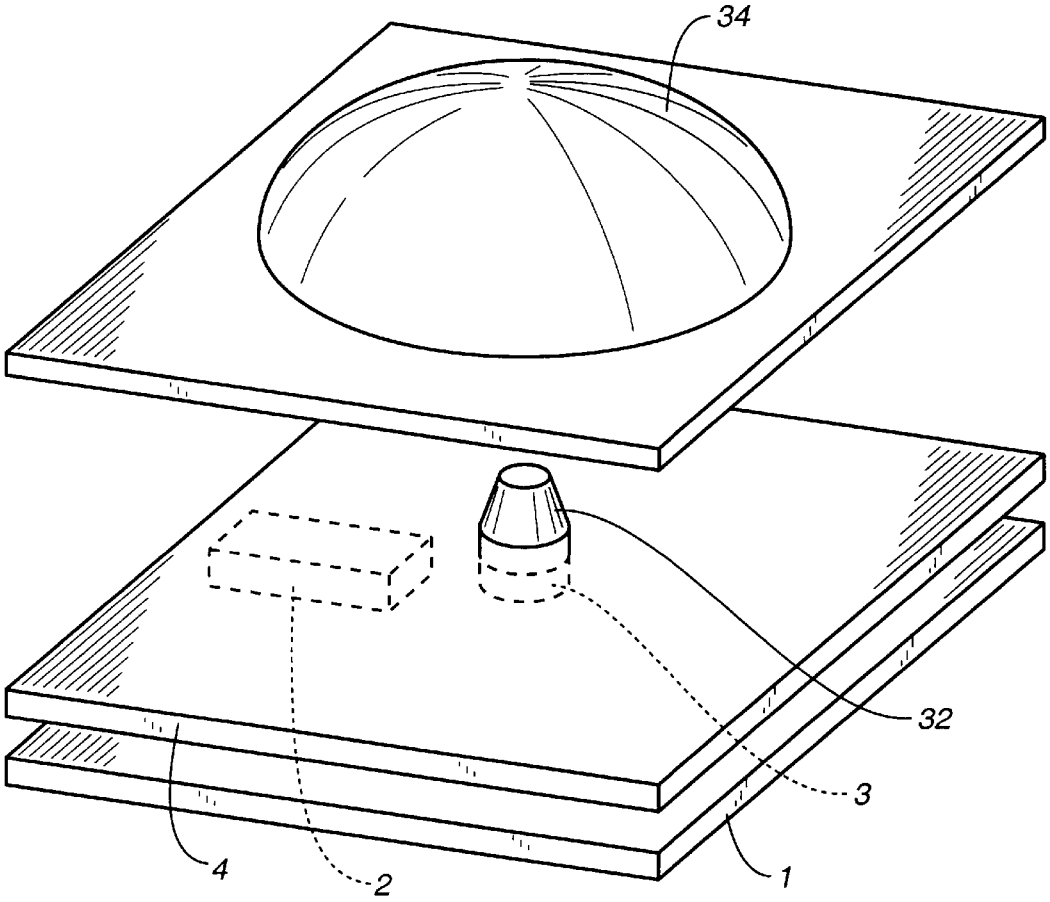
FIG. 7 is a diagonal view of an antenna according to a fifth embodiment of this invention.
Figure 8:
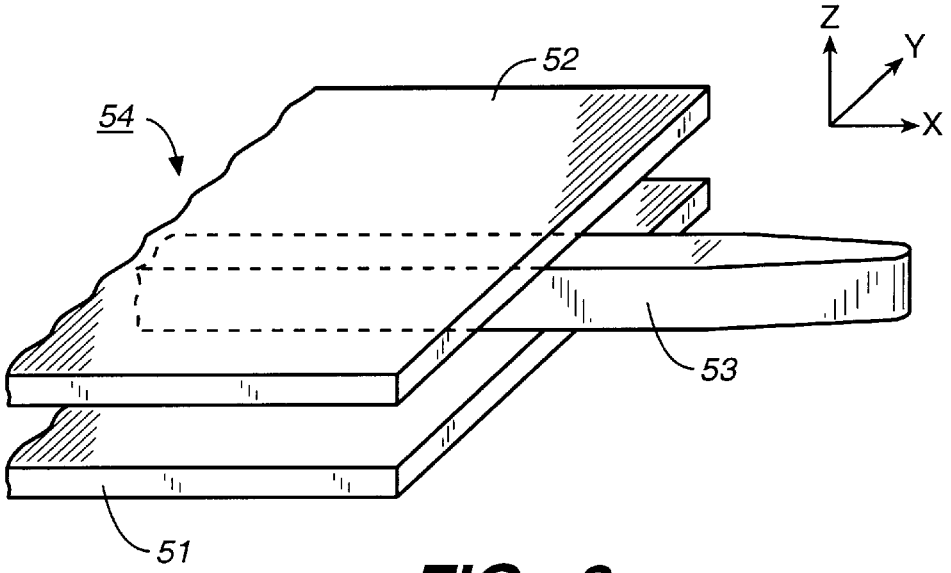
FIG. 8 (PRIOR ART)
FIG. 8 is a diagonal view of a prior art antenna.
Figure 9:
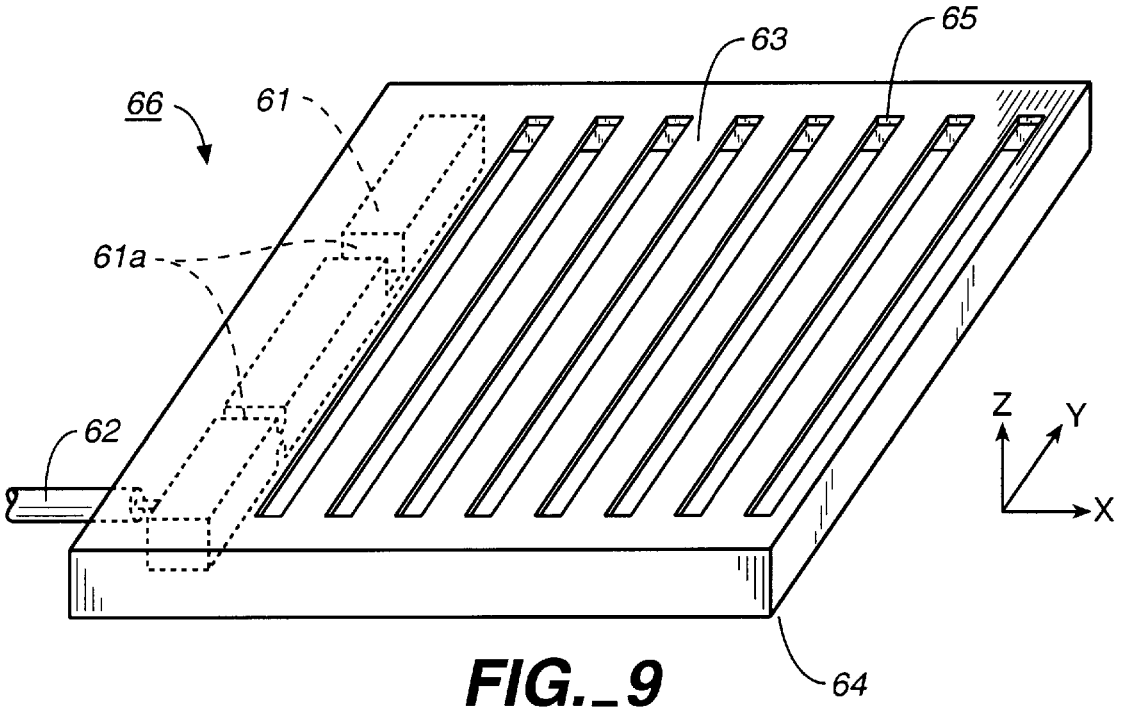
FIG. 9 (PRIOR ART)
FIG. 9 is a diagonal view of another prior art antenna.

FIG. 7 shows still another antenna according to a fifth embodiment of this invention, characterized as having a dielectric lens 34 over the planar conductor 4 of an antenna structured as shown in FIGS. 5A and 5B, corresponding to the opening 4*a*. The dielectric lens 34 may be formed with a material such as polyethylene, polypropylene and Teflon, affixed to the upper surface of the planar conductor 4, for example, through spacer by using screws. The lens 34 serves to concentrate electromagnetic waves in the neighborhood of the rod and hence to improve the gain of the antenna. A similar dielectric lens may be attached to any of the other antennas described above.

In summary, antennas according to this invention are characterized as having between planar conductors a dielectric resonator adapted to couple with a dielectric strip and hence being capable of radiating electromagnetic waves perpendicularly to the millimeter wave circuit formed by a NRD guide. Since they can thus be disposed perpendicularly to the direction of motion of an automobile, when used in a collision-warning radar, it is possible to provide a thinner radar head in the direction of motion of the automobile.

Since the source of radiation of electromagnetic waves is localized according to this invention to the opening in the upper planar conductor of the antenna or to the dielectric rod, furthermore, the antennas according to this invention are simpler in structure than prior art planar antennas having several openings to radiate waves therethrough. High levels of precision are not required in the production, and fluctuations in characteristics are reduced. Antennas according to this invention can be made more compact.

Moreover, the efficiency of antennas can be improved by improving their directionality and antenna gain, if the planar shape of the opening through the upper planar conductor is changed to a rectangle or a cross, or if it is made trapezoidal.

If one or more additional dielectric resonators are inserted between the dielectric strip and the first dielectric resonator on the line extended longitudinally from the dielectric strip, the filtering effect against spurious radiation is improved and unwanted effects on other systems can be eliminated. If a dielectric lens is disposed above the opening formed through the upper planar conductor, the gain of the antenna is further improved.

What is claimed is:

1. An antenna comprising:

a first planar conductor;

second planar conductor;

a longitudinally elongated dielectric strip disposed between said first planar conductor and said second planar conductor and extending to a front end;

a dielectric resonator disposed between said first planar conductor and said second planar conductor and in front of said front end on a longitudinally extended axis of said dielectric strip and without overlapping longitudinally with said dielectric strip;

said second planar conductor having at least one opening for radiating electromagnetic waves perpendicularly to said second planar conductor therethrough.

2. The antenna of claim 1 wherein said opening in said second planar conductor is rectangular in planar shape.

3. The antenna of claim 1 wherein said opening in said second planar conductor is cross-shaped.

4. The antenna of claim 1 wherein said opening in said second planar conductor is cross-sectionally trapezoidal.

5. The antenna of claim 1 further comprising a dielectric rod connected to said dielectric resonator and disposed through said opening in said second planar conductor.

6. The antenna of claim 5 wherein said dielectric resonator and said dielectric rod are unitarily formed.

7. The antenna of claim 1 further comprising another dielectric resonator disposed between said dielectric strip and said dielectric resonator.

8. The antenna of claim 1 further comprising a dielectric lens disposed over said opening in said second planar conductor.

9. The antenna of claim 1 wherein said dielectric strip serves as a nonradiative dielectric waveguide and is capable of allowing electromagnetic waves to propagate therealong in an LSM mode.

10. The antenna of claim 1 wherein said dielectric strip has an open end having a planar surface which is separated from said dielectric resonator.

11. The antenna of claim 1 wherein said dielectric strip and said dielectric resonator are electromagnetically coupled.

12. The antenna of claim 1 wherein electromagnetic waves transmitted to said dielectric strip generate an electric field with a component perpendicular to said longitudinally elongated dielectric strip and parallel to said first planar conductor and said second planar conductor and a magnetic field with a component perpendicular to said first planar conductor and said second planar conductor.

13. An antenna comprising:

a first planar conductor;

two longitudinally elongated dielectric strips mutually perpendicularly disposed on said first planar conductor;

a dielectric resonator disposed at a point where longitudinally extended axes of said dielectric strips cross each other; and a second planar conductor covering upper surfaces of said dielectric strips and having an opening above said dielectric resonator.

14. The antenna of claim 13 wherein said opening in said second planar conductor is rectangular in planar shape.

15. The antenna of claim 13 wherein said opening in said second planar conductor is cross-shaped.

16. The antenna of claim 13 wherein said opening in said second planar conductor is cross-sectionally trapezoidal.

17. The antenna of claim 13 further comprising a dielectric rod connected to said dielectric resonator and disposed through said opening in said second planar conductor.

18. The antenna of claim 17 wherein said dielectric resonator and said dielectric rod are unitarily formed.

19. The antenna of claim 13 further comprising another dielectric resonator disposed between said dielectric strip and said dielectric resonator.

20. The antenna of claim 13 further comprising a dielectric lens disposed over said opening in said second planar conductor.

21. An antenna comprising:

a first planar conductor;

two longitudinally elongated dielectric strips mutually perpendicularly disposed on said first planar conductor;

a dielectric resonator disposed at a point where longitudinally extended axes of said dielectric strips cross each other; and a second planar conductor covering upper surfaces of said dielectric strips and having an opening above said dielectric resonator.

22. The antenna of claim 21 wherein said opening in said second planar conductor is rectangular in planar shape.

23. The antenna of claim 21 wherein said opening in said second planar conductor is cross-shaped.

24. The antenna of claim 21 wherein said opening in said second planar conductor is cross-sectionally trapezoidal.

25. The antenna of claim 21 further comprising a dielectric rod connected to said dielectric resonator and disposed through said opening in said second planar conductor.

26. The antenna of claim 25 wherein said dielectric resonator and said dielectric rod are unitarily formed.

27. The antenna of claim 21 further comprising another dielectric resonator disposed between said dielectric strips and said dielectric resonator.

28. The antenna of claim 21 further comprising a dielectric lens disposed over said opening in said second planar conductor.

29. An antenna comprising:

a first planar conductor;

a longitudinally elongated dielectric strip disposed on said first planar conductor;

a dielectric resonator disposed on a longitudinally extended axis of said dielectric strip and longitudinally separated from said dielectric strip; and a second planar conductor covering upper surface of said dielectric strip and having a single opening above said dielectric resonator.

30. The antenna of claim 29 wherein said opening in said second planar conductor is rectangular in planar shape.

31. The antenna of claim 29 wherein said opening in said second planar conductor is cross-shaped.

32. The antenna of claim 29 wherein said opening in said second planar conductor is cross-sectionally trapezoidal.

33. The antenna of claim 29 further comprising a dielectric rod connected to said dielectric resonator and disposed through said opening in said second planar conductor.

34. The antenna of claim 33 wherein said dielectric resonator and said dielectric rod are unitarily formed.

35. The antenna of claim 29 further comprising another dielectric resonator disposed between said dielectric strip and said dielectric resonator.

36. The antenna of claim 29 further comprising a dielectric lens disposed over said opening in said second planar conductor.

37. The antenna of claim 29 wherein said dielectric strip is capable of allowing electromagnetic waves to propagate therealong in an LSM mode.

38. The antenna of claim 29 wherein said dielectric strip has an open end having a planar surface which is separated from said dielectric resonator.

39. The antenna of claim 29 wherein said dielectric strip is sandwiched between said first planar conductor and said second planar conductor in a face-to-face contacting relationship therewith.

* * * * *